United States Patent [19]

Morane

[11] Patent Number: 4,638,927

[45] Date of Patent: Jan. 27, 1987

[54] CONTAINER FOR STORING AND DISPENSING A LIQUID PRODUCT AND AT LEAST ONE ADDITIONAL PRODUCT WHICH ARE TO REMAIN SEPARATED DURING STORAGE

[75] Inventor: Bruno P. Morane, Neuilly, France

[73] Assignee: L'Oreal, Paris, France

[21] Appl. No.: 731,875

[22] Filed: May 8, 1985

[30] Foreign Application Priority Data

May 15, 1984 [FR] France ..... 84 07497

[51] Int. Cl.[4] ..... B65D 25/08; B67D 5/56

[52] U.S. Cl. ..... 222/83; 206/222; 215/DIG. 8; 222/80; 222/129; 222/215; 604/88; 604/91; 604/415

[58] Field of Search ..... 222/80, 81, 82, 83, 222/83.5, 153, 85–90, 135, 136, 145, 206, 209, 215, 541–542, 129; 206/219, 221, 222; 215/DIG. 8; 604/82, 91, 87–89, 415, 416

[56] References Cited

U.S. PATENT DOCUMENTS

| | | | |
|---|---|---|---|
| 1,759,459 | 5/1930 | Murdock | 222/89 X |
| 2,275,567 | 3/1942 | Smith | 604/416 |
| 2,524,364 | 10/1950 | Smith | 206/222 |
| 2,524,365 | 10/1950 | Smith | 206/222 |
| 2,642,870 | 6/1953 | Smith | 206/222 |
| 2,653,609 | 9/1953 | Smith | 206/222 X |
| 2,659,370 | 11/1953 | Smith | 206/222 X |
| 2,721,552 | 10/1955 | Nosik | 215/DIG. 8 |
| 3,156,369 | 11/1964 | Bowes et al. | 206/222 |
| 3,347,410 | 10/1967 | Schwartzman | 222/80 |
| 3,521,745 | 7/1970 | Schwartzman | 215/DIG. 8 X |
| 3,739,947 | 6/1973 | Baumann et al. | 222/136 |
| 3,802,604 | 4/1974 | Morane et al. | 222/83 |
| 3,964,641 | 6/1976 | Langensiepen et al. | 222/83 X |
| 3,968,872 | 7/1976 | Cavazza | 604/416 X |
| 4,103,772 | 8/1978 | Wiegner | 206/222 |
| 4,301,948 | 11/1981 | Czech et al. | 222/341 |

FOREIGN PATENT DOCUMENTS

| | | | |
|---|---|---|---|
| 0099754 | 2/1984 | European Pat. Off. . | |
| 2211753 | 1/1972 | Fed. Rep. of Germany . | |
| 1083275 | 1/1955 | France | 222/80 |
| 1350383 | 4/1964 | France . | |
| 1559586 | 3/1969 | France | 206/222 |
| 1562697 | 4/1969 | France . | |
| 1568362 | 5/1969 | France . | |
| 2290366 | 6/1976 | France . | |
| 2291115 | 6/1976 | France . | |
| 2294937 | 7/1976 | France . | |
| 2305364 | 10/1976 | France . | |
| 2383844 | 10/1978 | France . | |
| 2453793 | 11/1980 | France . | |
| 2506726 | 12/1982 | France . | |
| 1383404 | 2/1975 | United Kingdom . | |

*Primary Examiner*—Joseph J. Rolla
*Assistant Examiner*—Kevin P. Shaver
*Attorney, Agent, or Firm*—Cushman, Darby & Cushman

[57] ABSTRACT

A container comprises a bottle for a liquid product and having at the end of its neck a leakproof envelope enclosing an additional product to be stored separately from the liquid in the bottle. A cap on the neck includes a slidable push button carrying a perforator to open the envelope in a central region of the envelope to allow the additional product to mix with the liquid and then to be discharged through an eccentric duct in the cap rather than having to pass through the center of the cap where the perforator is positioned.

9 Claims, 4 Drawing Figures

CONTAINER FOR STORING AND DISPENSING A LIQUID PRODUCT AND AT LEAST ONE ADDITIONAL PRODUCT WHICH ARE TO REMAIN SEPARATED DURING STORAGE

FIELD OF THE INVENTION

The present invention relates to a storage and dispensing container for a liquid product and at least one additional product which are separated during storage.

It is known that it may be necessary to keep separate during storage two compounds which must be dispensed and used simultaneously. This condition is imperative when the mixture or the solution of the two compounds is unstable in the long term as is the case, for instance, with certain medicinal or cosmetic preparations.

PRIOR ART

For this purpose, many embodiments of containers are already known which permit the separate storage of on the one hand a liquid product and, on the other hand, of a liquid, pulverulent or granular product and yet ensure the mixing or dissolution of these two products before they are dispensed.

In certain relatively simple devices, such as those described in French Pats. 1,350,383 and 1,559,586 and in the U.S. Pat. No. 3,156,369, a charge of a pulverulent or granular product is contained in a cartridge disposed in the neck of a bottle; this cartridge is closed at its lower portion but open at its upper portion which is surrounded by a collar bearing against the upper edge of the neck of the bottle; within this cartridge, there is engaged a tubular perforator with a chamfered lower edge which is next to the bottom of the cartridge. At its upper end, the perforator is integral with a push button which is protected by an external envelope surrounding at least a part of the bottle neck and which is held on this neck. This external envelope can be, as in the case of the two above mentioned French Patents, a metallic capsule crimped under one or more flanges of the neck and which must be removed to gain access to the push button, in order to depress the perforator axially inwardly of the bottle so that the perforator pierces the bottom of the cartridge whose charge thus drops into a liquid contained in the bottle. In certain cases, the perforator can only be depressed after removal of a shim having at least one frangible portion and disposed between the collar of the cartridge and a collar of the upper end of the perforator in order to prohibit, by virtue of its presence, any descent of the perforator. As described in the above mentioned United States Patent, the external envelope can also be a cap made of a plastic material which is screwed around a bottle neck and applies the cartridge collar in a leakproof manner against the upper edge of the neck via an internal shoulder, the upper portion of the cap having a central frangible disc which must be detached from the peripheral portion of the cap by the user's finger pressure in order to allow pressure on the button and the perforator. Because of the initial engagement of the perforator in the cartridge, the charge of the additional product contained in the cartridge cannot be kept in a leakproof compartment which can be very annoying when the additional product is physically or chemically sensitive to air, to water vapour or to the vapours of the liquid contained in the bottle. Moreover, in the opened cartridge the additional product can no longer be stored totally independently of the liquid in the bottom of tne container. Finally, the dispensing of the mixture or of the solution can only be effected through the cartridge after the perforator has been removed, or through the bottle neck after removal of the stoppering device constituted by the cartridge, the perforator and, in certain cases, any external envelope whose removal is necessary for gaining access to the perforator. In these cases, these operations necessitate specific interventions on the part of the user.

In other known embodiments, the two products are stored in a leakproof manner but the devices are relatively expensive to manufacture. U.S. Pat. Nos. 2,524,364, 2,524,365, 2,642,870, 2,653,609 and 2,659,370 describe many variants of the device comprising essentially a bottle containing a liquid and having its neck obturated by a stopper of rubber or a similar material which has at least one lower cut-out to accommodate a pellet of the additional product. The cut-out is closed on the inner side of the bottle either by a disc elastically secured or squeezed into position in the stopper, or by a lower diaphragm intended to be perforated. On the outer side of the bottle, the lower cut-out is closed by an upper diaphragm which is either extensible or intended to be perforated and which separates the lower cut-out from at least one upper cut-out of the stopper; in this upper cutout, there is engaged the lower end of an axial element whose upper end is integral with the central upper and deformable portion of a cap, also of rubber or a similar material; a lateral wall of the said cap at least partly surrounds the stopper and/or the bottle neck and is anchored by its lower portion, possibly in the form of an internal bead, either against or below a flange of the stopper which is itself tightened against or below a flange of the bottle neck or yet again fastened by a flange against a flange of the stopper by an integrity strip held under a flange of the bottle neck.

The axial element integral with the cap is either a tubular perforator which pierces the upper diaphragm and drives the disc towards the inside of the bottle and may also pierce the lower diaphragm when the upper portion of the cap is elastically driven towards the pellet which can thus fall into the bottle, or a push button which is possibly solid and may have for instance, a frustoconical shape with the small end lowermost to stretch the upper diaphragm and to drive the disc, pushing the pellet into the bottle. In view of the small diameter of the perforator, of the chamfered form of its lower end, and of the nature of the material constituting the diaphragm or diaphragms, in the embodiments provided with a perforator the holes in the diaphragm or diaphragms are generally self-obturating holes which close up again when the perforator has been elastically returned into its initial position after pressure on the upper portion of the cap has been relaxed.

As a result the mixture or the solution cannot be dispensed, even by turning the container upside down, and it is necessary to use either a hypodermic syringe which is lowered into the central duct of the perforator and into the diaphragm or diaphragms, or to remove the stoppering device comprising the stopper the cap and the perforator in order to allow the mixture to be poured out. This is all the more necessary in embodiments where the upper end of the tubular perforator does not open out to the outside of the upper portion of the cap, but instead opens at the level of a cover to be pierced for drawing off the contents of the bottle by a syringe. When the axial element is a push button, it is also necessary either to withdraw the stoppering device or to withdraw the cap and the perforator and then to pierce the stopper by means of a syringe. Whatever procedure is followed, specific manual operations by the user are necessary and the mixture is only allowed to pass via the perforator through the duct accommodating the perforator if it is withdrawn from the cap after being depressed or through the bottle neck.

In order to permit an easier dispensing of the mixture or solution by means of a device whose structure is simpler and whose manufacture is less expensive and wherein the two products are stored in a leakproof manner and independently of each other, the assignees of the applicant have already proposed a storage and dispensing container of this type in French Pat. No. 71-08902 wherein the additional product is contained in a covered pot, disposed inside the bottle neck and having one flange applied against the end edge of the neck by an internally threaded stopper cooperating with an external thread of the neck, the neck comprising in its central portion an opening for a tubular perforator which is capable of sliding translationally in relation to the stopper, over an adequate travel, for passing from a storage position opposite the cover of the pot to a second position where it perforates the cover and the bottom of the pot, the perforator being integral with a cap which is slidable on the stopper and which comprises a perforated dispenser fitting disposed as an extension of the perforator.

After the sliding of the perforator and a mixing of the product, promoted for instance by shaking, it suffices to upend the container to effect the desired dispensing by way of gravity through the fitting, or even to press and deform the pliable wall of the bottle to evacuate the mixture via the end fitting.

As all the components of such a container can be made of a moulded plastic material, it will be understood that its cost can be relatively low. However, in order to simplify the making of this device still further and to reduce its height to facilitate storage, the assignees of the applicant have proposed, in the first Certificate of Addition No. 72-02321 based on French Pat. No. 71-08902, a variant wherein the threaded button is dispensed with.

In that variant, the flange of the lateral wall of the covered part which bears on the end edge of the bottle neck, is crimped on that end, and the cap and the perforator integral therewith can slide, while being guided by at least one zone of the wall of the bottle and the cap comprises at least one element capable of cooperating with a stop arranged on the lateral wall of the bottle so that preferably after removal of a detachable integrity strip disposed between the cap and the bottle, the cap can be rotated in relation to the bottle, abutment of a cap element on an element of the bottle (to keep the perforator removed from the part cover during storage) is eliminated and subsequently, the cap can be slid relative to the bottle to perforate the covered pot for mixing the two products.

The fact remains that in this embodiment, as in the preceding ones, the mixture is dispensed through the annular perforator. Moreover, taking into account the presence of the slender-shaped end fitting in the extension of the perforator and projecting on the top of the central portion of the cap, it is necessary to make provision in the upper portion of the cap for a large annular disc performing the function of the push element offering a sufficient bearing surface to manipulate the perforator without the user having to exert considerable force.

The object of the present invention is to provide a container of the above mentioned type wherein the two products can be stored separately in a leakproof manner and which has an economic manufacturing structure allowing the mixture to be dispensed without passing through the perforator and without it being necessary to remove the perforator, making it possible, moreover, to benefit from a perforator having a large bearing surface.

SUMMARY OF THE INVENTION

The present invention provides a new industrial product constituted by a storage and dispensing container for a liquid product and at least one other additional product, in liquid or powder form, the first mentioned liquid product being contained in a bottle whose neck is surmounted by a cap comprising a dispenser fitting, the said additional product being contained in a leakproof envelope kept poised by means of a peripheral flange on the end edge of the bottle neck, a perforator being located opposite the leakproof envelope during storage and being intended to slide in relation to the bottle over a travel sufficient to perforate two opposed portions of the leakproof envelope, characterised in that the cap fixed on the bottle comprises a central duct wherein the perforator is slidably mounted, and an eccentric duct forming the dispenser fitting. Thus, after the perforator has been depressed and the leakproof envelope perforated, said additional product is mixed with the first-mentioned liquid product in the bottle and the mixture resulting therefrom is dispensed not via the perforator but via the eccentric dispenser fitting, and there is thus enough room in the central portion of the cap for mounting a perforator with a large bearing surface. For this reason, the perforator is advantageously integral at its upper portion with a push button comprising a peripheral skirt surrounding the upper portion of the perforator, the push button sliding along the internal surface of the central duct of the cap. The bearing surface can thus be delimited on the push button whilst the perforator can retain a limited transverse cross section, which is favourable to a proper perforation of the leakproof envelope, not only by reason of the shape of the perforator cross-section but also because of the amplification of the perforation pressure in the ratio of the areas of the bearing surface and the surface of the transverse cross section of the perforator, in particular at its lower end.

In order to avoid any leakage of the mixture between the skirt of the push button and the internal surface of the central duct, when the container is upended or when the lateral wall of the bottle is pressed and deformed for dispensing the mixture via the eccentric duct, the skirt of the push button has, projecting on its external surface, at least one circular bead ensuring leakproof sliding of the skirt in the central duct.

With a view to facilitating the flow of the dispensed mixture towards the eccentric duct, whereas the perforation of the leakproof envelope to release the mixture from the bottle is effected in the central portion of the bottle neck, the lower portion of the skirt of the push button has at least one gap allowing the dispensed contents of the bottle to pass in a substantially radial direction towards the eccentric duct after the perforator has been depressed and the leakproof envelope has been perforated. For the same reason, the lower portion of the central duct has at least one gap allowing the contents of the bottle to pass in a substantially radial direction towards the eccentric duct.

In a preferred limited capacity variant of the embodiment, which is simple to make and allows a saving in the material constituting the cap, the two ducts of the cap are adjacent one another and share a common wall having at least one of the passage gaps of the lower portion of the central duct.

In order to obtain in the leakproof envelope perforations with a progressive opening and whose shape promotes the pouring of the whole of the additional product into the liquid product contained in the bottle, the perforator advantageously has a channel-shaped transverse cross-section except at its lower end which is formed by a V-shaped tip directed towards the bottom as an extension of the web of the channel.

In a simple embodiment allowing moreover separate storage of an additional product in good condition, the leakproof envelope is a thermoformed shell with a dome-shaped upper cover in its central portion and fixed in a leakproof manner via its peripheral edge to the peripheral edge of a substantially flat lower cover so that the additional product is contained in a chamber delimited between the central portions of the two covers, the thermoformed shell being disposed above the plane passing through the end edge of the bottle neck. This disposition of the thermoformed shell on the neck and not in the neck as is the case in all the embodiments of the prior art, in particular, simplifies the assembly of the container and makes it possible to utilise a larger internal volume of the bottle to accommodate the liquid product. In this case, in order to ensure leakproof storage of the liquid product in the bottle when the thermoformed shell is fitted on the neck, and before the cap is fixed, the lower cover of the thermoformed shell is heat-sealed at its peripheral edge to the end edge of the neck of the bottle. Preferably, the peripheral edge of the leakproof envelope is, moreover, applied against the end edge of the bottle neck by an internal radial shoulder of the cap.

In a simple embodiment, the lower portion of the cap has the shape of a tubular section which is fitted on the bottle neck and which has an outwardly extending recess to be elastically catch-engaged behind a laterally outwardly projecting peripheral bead around the bottle neck.

Finally, the position of the perforator in relation to the cap during storage is maintained thanks to a detachable integrity strip whose presence indicates that the container has not yet been used and which must be removed to allow the perforator to slide in relation to the cap.

BRIEF DESCRIPTION OF THE DRAWINGS

To render the invention more readily understood, one embodiment will now be described with reference to the attached drawings, by way of purely illustrative and non restrictive example. In the drawings.

DESCRIPTION OF THE PREFERRED EMBODIMENT

Figure 1:
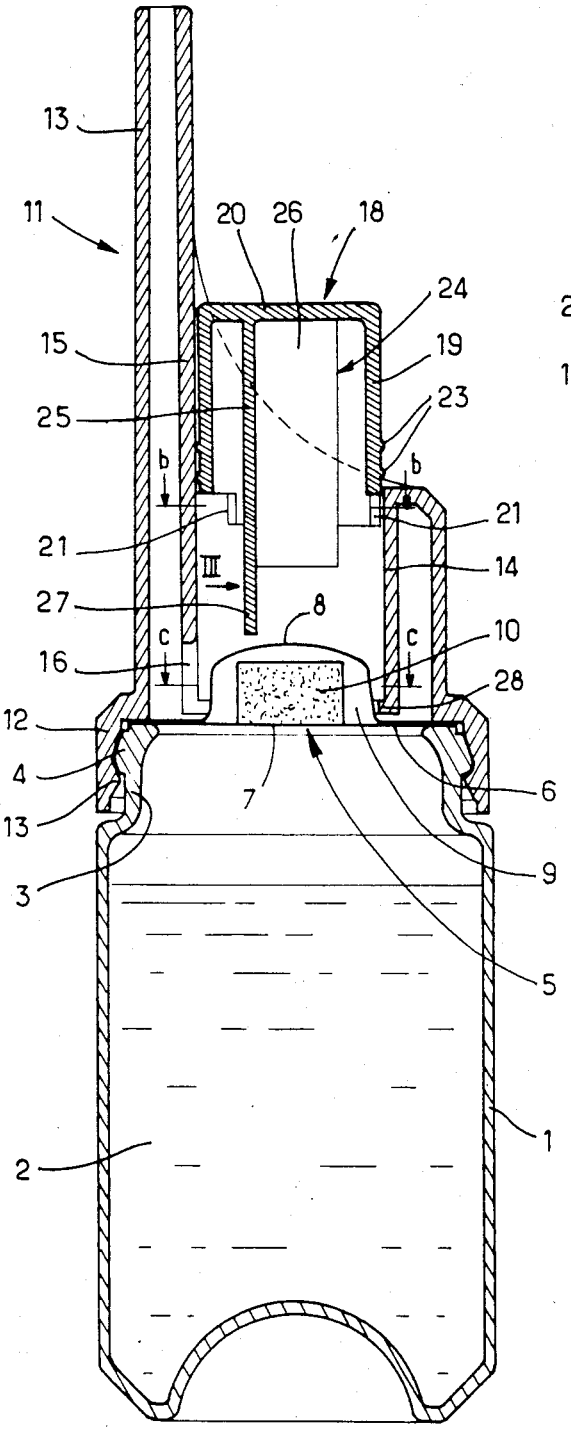
FIG. 1 is an axial cross-section of a container according to the invention, comprising a central perforator sliding in a cap provided with an eccentric dispenser fitting, the container being in the storage position.

Referring to FIG. 1, there will be seen a polyethylene bottle 1, with an upwardly dome-shaped bottom, and containing a liquid 2. Bottle 1 has a neck 3 having a laterally or radially outwardly projecting peripheral bead 4. Heat sealed against the upper end edge of neck 3, is the peripheral flange 6 of a thermoformed shell 5. This shell 5 is constituted by a bottom cover 7, substantially in the shape of a flat disc, and by a cap-shaped top cover 8 whose central portion is upwardly domed and whose peripheral flat edge is applied against the peripheral edge of the bottom cover 7. The two covers 7 and 8 thus delimit, between their central portions, a chamber 9 accommodating a pellet 10 of an additional product and, so as to store pellet 10 away from air and water vapor and the liquid 2, this chamber 9 is sealed in a leakproof manner by thermowelding or heat sealing the edges of the two covers 7 and 8 to each other, forming the flange 6 of shell 5. It is clear that manufacture of the shell 5 is advantageously effected on a separate assembly line, distinct from the production lines of the bottles 1 and the lines where the latter are filled with liquid 2, as well as from the production lines of the cap described below, and from the container assembly line.

Figure 2:
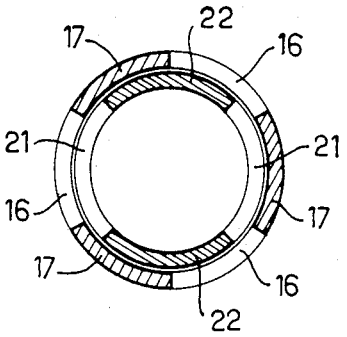
FIG. 2 is a combination, in the same plane, of two transverse cross-sectional views respectively along line b—b of the base of the push button of the perforator and along line c—c of the base of the central duct of the container of FIG. 1.
Figure 3:
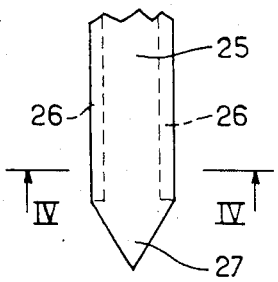
FIG. 3 is a view, along the direction of arrow III, of the perforator of the container of FIGS. 1 and 2.
Figure 4:
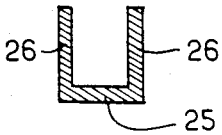
FIG. 4 is a transverse cross-sectional view of the perforator along line IV—IV of FIG. 3.

A cap 11, also of polyethylene, is fixed on the bottle 1. The cap 11 has a lower portion shaped as a tubular section 12 whose transverse cross-sectional shape corresponds to that of the transverse cross-section of neck 3 and which is fitted on and around the neck 3 by being fitted thereon by elastic catch engagement of a recess 13 extending radially inwardly on the internal surface of section 12, under the external bead 4 of neck 3. The internal surface of the section 12 is joined to the internal surface of the rest of the cap 11 via an internal radial shoulder wherewith the peripheral flange 6 of shell 5 is held tightly against the upper end edge of neck 3 to improve the storage seal for the liquid 2 in the bottle 1 when cap 11 is in place. At its upper portion, the moulded cap 11 comprises a dispenser fitting constituted by an eccentric duct 13 and a central duct 14. The eccentric duct 13, in the shape of a long and narrow lateral tube, and the central duct 14 which is shorter but of a considerably larger internal diameter than the duct 13, are adjacent and have a common wall 15. The central duct 14, whose upper opening is contained in a circular cross-section cylindrical surface portion having a horizontal axis which, being transverse in relation to the plane of FIG. 1, and whose periphery progressively and regularly joins the periphery of the eccentric duct 13, has its open end situated a short distance above the peripheral flange 6 of the shell 5 and around the central domed portion of this shell 5 containing the pellet 10. As represented in FIG. 2, three gaps 16, each opening over an angular sector of 60°, are regularly distributed over the periphery and separated by wall portions 17 which also extend over an angular sector of 60°, are formed at the lower end of the central duct 14 and thus delimit three radial passages whereof one, situated at the lower end of common wall 15 of the two ducts 13 and 14, constitutes a radial passage between the central duct 14 and the eccentric duct 13. In the central duct 14 there is slidably mounted a push button 18, comprising a tubular skirt 19 and closed at its upper end by a horizontal actuating face 20 having a large surface. At its open lower end, as represented in FIG. 2, there are formed in the skirt 19 two gaps 21, each opening over an angular sector of 90° and separated by two wall sections 22 also each extending over an angular sector of 90°, one of the gaps 21 opening opposite the common wall 15 of the two adjacent ducts 13 and 14. The portion of the skirt 19 which is just above the gap 21 carries two radially outwardly projecting circular beads 23, axially interspaced from each other and ensuring a leakproof sliding fit for the skirt 19 of the push button 18 along the internal surface of the central duct 14. A perforator 24 moulded integrally with the push button 18 extends axially therewithin and is partially surrounded by the cap skirt 19. As shown in FIGS. 3 and 4, the perforator 24 has at its lower end a channel-shaped cross section whose web 25 and whose two vertical sides 26 are joined at their upper end to the lower surface of the push button disc 20, whilst the web 25 is extended at its lower end beyond the horizontal lower ends of sides 26 by a V shaped tip 27, constituting the perforator point of the perforator 24. As shown in FIG. 1, the point 27 and the lower ends of sides 26 are situated well below the lower end of the cap skirt 19 and the point 27 is slightly above the domed portion of the shell 5 in the storage configuration of the container. In this storage configuration the push button 18 and its perforator 24 are held in the position shown in FIG. 1 in relation to cap 11 and hence also in relation to the bottle 1. This is preferably ensured by a frangible integrity strip or tab (not shown) initially disposed between the cap skirt 19 and the internal duct 14, at the lowest height level of the duct 14, (on the right of FIG. 1), for instance, between the lower bead of the cap skirt 19 and the gap 21 on that side. In order to ensure the leakproof storage of the liquid 2 in the bottle 1 as soon as possible when the container is assembled and to ensure a proper hold of the shell 5 in position on the neck 3, before and during the fixing of cap 11 on bottle 1, it is preferably for the shell 5 to be fixed to the neck 3 by heat sealing the peripheral flange 6 of the shell 5 on the end edge of the neck 3, thus suitably positioning the shell 5 just above the plane passing through this edge.

The device described above is used as follows: Starting from the storage configuration of FIG. 1, the user tears off the detachable integrity tab which holds the push button 18 in position in relation to the cap 11. Then he or she presses on the push button disc 20 to drive down the push button 18 and the perforator 24 in the central duct 14 towards the shell 5. First of all the point 27 of the perforator first comes into contact with the top cover 8 and perforates it, then it passes through the pellet 10 and subsequently perforates the lower cover 7, thanks to its V-shaped form. The holes thus formed in the covers 8 and 7 progressively open out, and then the passage of the lower ends 26 causes slits substantially perpendicular to the holes, to form substantially rectangular openings of a relatively large area in the covers 8 and 7, these large openings allowing the additional product 10 to drop into the liquid 2. When the push button 18 has been depressed as far as possible, the wall portions 22 of the lower end of the skirt 19 abut against a small internal flange 28 of the wall portions 17 at the base of the central duct 14. In this position, one of the gaps 21 of the skirt 19 is in register with the gap 16 in the base of the common wall 15. Since the shell 5 has been pierced the interior of the eccentric duct 13, which is already open at its upper end, communicates with the interior of bottle 1 by way of the gaps 16 and 21 and by way of the openings in the shell 5. When the bottle 1 is upended, or when it is squeezed and deformed, its contents 1 flow out to the eccentric duct 13 and can thus be dispensed towards the outside.

It is clear that all the container components may be made of a moulded plastic material so that its cost can be low, especially since the assembly of the various components is easy and, during its production, storage of the liquid product in the bottle and of the additional product contained in the leakproof shell 5 can be easily stored separately from one another.

It shall be duly understood that the embodiment described above is in no way restrictive, and can give rise to any desirable modification without thereby departing from the spirit and scope of the invention.

I claim:

1. In a storage and dispensing container for a liquid product and at least one other additional product in liquid or powder form, comprising:

(a) a bottle containing said liquid product;

(b) a neck to said bottle, said neck having an end edge;

(c) a cap on said neck;

(d) a dispenser fitting to said cap;

(e) a leakproof envelope having two opposed wall portions and a peripheral flange held on said end edge of the bottle neck and containing said at least one additional product;

(f) perforator means in said cap slidably mounted in relation to the bottle neck and located, during storage of said liquid product and at least one additional product, in a position opposite the leak proof envelope, said perforator being adapted to slide from said position through a distance for it to effect perforation of said two opposed wall portions of the leakproof envelope; the improvement wherein (g) said cap comprises central duct means enclosing the slidably mounted perforator means and (h) said dispenser fitting comprises an eccentric duct means or said cap;

said perforator means having an upper portion with a push button integral therewith, said push button comprising a peripheral skirt surrounding said upper portion of said perforator means and said peripheral skirt being slidable along the internal surface of the central duct means of the cap, said lower portion of said skirt of said push button including gap means allowing the contents of the bottle to pass in a substantially radial direction towards the eccentric duct means for dispensing, after said perforator means has been depressed and said leakproof envelope has been perforated.

2. A container according to claim 1, wherein said skirt of the push button has at least one circular bead projecting from its external surface for ensuring leakproof sliding of said skirt in the central duct means.

3. A container according to claim 1, wherein said central duct means has a lower portion defining at least one gap allowing the contents of the bottle to pass in a substantially radial direction towards the eccentric duct means upon dispensing.

4. A container according to claim 1, wherein said central duct means has a lower portion defining at least one gap allowing the contents of the bottle to pass in a substantially radial direction towards the eccentric duct means upon dispensing and wherein the said central and eccentric duct means of the cap are adjacent one another and share a common wall which has said at least one gap of the lower portion of the central duct means.

5. A container according to claim 1, wherein the perforator mean has a channel-shaped transverse cross-section and a lower end which is formed by a V-shaped point directed downwardly.

6. A container according to claim 1, wherein the leakproof envelope is a thermoformed shell, said two opposed wall partions comprising top and bottom walls, said top wall being a top cover upwardly domed in its central portion and fixed in a leakproof manner at its peripheral edge to the peripheral edge of said bottom wall, said bottom wall being substantially flat, and wherein said additional product is contained in a chamber defined between the top and bottom walls, the thermoformed shell being disposed just above said end edge of the neck of said bottle.

7. A container according to claim 6, characterised in that the bottom wall of the thermoformed shell is heat-sealed at its peripheral edge on the end edge of the neck of the bottle.

8. A container according to claim 1, wherein the peripheral flange of the leakproof envelope is applied against the end edge of the bottle neck by a radial internal shoulder of the cap.

9. A container according to claim 1, wherein the neck of the bottle includes an outwardly projecting external peripheral bead, and wherein the lower portion of the cap (11) has the shape of a tubular section which is fitted on the neck of the bottle and which has an inwardly facing recess positioned to be engaged behind said peripheral bead of the bottle neck.

* * * * *